US006142220A

United States Patent [19]

Motegi et al.

[11] Patent Number: 6,142,220

[45] **Date of Patent: *Nov. 7, 2000**

[54] FINNED HEAT EXCHANGER

[75] Inventors: Hitoshi Motegi, Kusatsu; Shoichi Yokoyama; Osamu Aoyagi, both of Otsu, all of Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/941,390

[22] Filed: Sep. 30, 1997

[30] Foreign Application Priority Data

Oct. 2, 1996 [JP] Japan ..... 8-261514
Oct. 31, 1996 [JP] Japan ..... 8-289525

[51] Int. Cl.[7] ..... F28F 13/00; F28D 1/053

[52] U.S. Cl. ..... 165/135; 165/139; 165/110; 165/150; 165/151

[58] Field of Search ..... 165/144, 145, 165/150, 151, 135, 110, 146, 139

[56] References Cited

U.S. PATENT DOCUMENTS

| | | | |
|---|---|---|---|
| 1,870,457 | 8/1932 | Kenney | 165/140 |
| 4,344,482 | 8/1982 | Dietzsch | 165/150 X |
| 4,831,844 | 5/1989 | Kadle | 165/150 X |
| 4,995,453 | 2/1991 | Bartlett | 165/150 |
| 5,076,353 | 12/1991 | Haussmann | 165/110 |
| 5,219,023 | 6/1993 | Kadle | 165/110 |
| 5,542,271 | 8/1996 | Kudoh et al. | 165/146 X |

FOREIGN PATENT DOCUMENTS

| | | | |
|---|---|---|---|
| 58-108394 | 6/1983 | Japan | 165/135 |
| 61-153393 | 7/1986 | Japan | 165/151 |
| 63-183391 | 7/1988 | Japan . | |
| 2-64393 | 3/1990 | Japan | 165/135 |
| 2-64396 | 3/1990 | Japan | 165/135 |
| 2-217792 | 8/1990 | Japan . | |
| 2-290493 | 11/1990 | Japan | 165/150 |
| 3-194370 | 8/1991 | Japan | 165/135 |

*Primary Examiner*—Leonard Leo
*Attorney, Agent, or Firm*—Wenderoth, Lind & Ponack, L.L.P.

[57] ABSTRACT

A finned heat exchanger includes a plurality of elongated fins which are arranged at a predetermined interval in parallel with one another such that air flows between neighboring ones of the fins in a predetermined direction. A plurality of heat transfer tubes which contain refrigerant passing therethrough are orthogonally inserted through the fins so as to be arranged in a plurality of columns on the fins. When the finned heat exchanger is operated for condensation, the heat transfer tubes are provided in two paths in the vicinity of an inlet for the refrigerant and are provided in one path in the vicinity of an outlet for the refrigerant, such that the heat transfer tubes of the one path occupy about 5 to 30% of all the heat transfer tubes.

14 Claims, 13 Drawing Sheets

FINNED HEAT EXCHANGER

BACKGROUND OF THE INVENTION

The present invention relates to a finned heat exchanger widely used as a condenser for an air-conditioner or a refrigeration machine.

At the time of a condensation operation of a known finned heat exchanger, refrigerant flows into two paths from inlet tubes 1 and 2 and flows out of two paths from outlet tubes 8 and 9 as shown in FIG. 11, so that an area of the flow path of the refrigerant is increased and pressure loss of the refrigerant is reduced in order to obtain higher performance.

At the time of a condensation operation of a heat exchanger, the state of refrigerant in the heat exchanger is classified into a superheated vapor range, a vapor-liquid two phase range and a subcooled liquid range. Of these ranges, the vapor-liquid two phase range in which the refrigerant has latent heat of condensation contributes most to heat exchange. Meanwhile, the subcooled liquid range is essential from a standpoint of stability of the refrigeration cycle and promotion of the refrigeration effect.

However, in the above known finned heat exchanger having two paths, since the condensation temperature of the refrigerant in the heat exchanger has dropped due to recent trends towards energy saving, a difference between the condensation temperature of the refrigerant in the heat exchanger and the temperature of air subjected to heat exchange becomes quite small, so that subcooling should be performed sufficiently. If subcooling is performed sufficiently, the subcooled liquid range which scarcely contributes to heat exchange increases greatly in the heat exchanger, thereby resulting in a drop of the capability of performing heat exchange.

In addition, if the condensation temperature is lowered and subcooling is performed sufficiently so as to improve the coefficient of performance of an air-conditioner or a refrigeration machine when the known finned heat exchanger of FIG. 11 is used as a condenser, the subcooled liquid range of the refrigerant is lower by one digit than the vapor-liquid two phase range and the difference between the condensation temperature and the temperature of air is small. Therefore, the heat transfer performance is low and the length in which the refrigerant flows in the heat transfer tube in the subcooled state becomes excessively large, thereby resulting in a large drop of the capability of the finned heat exchanger as a whole of performing heat exchange.

Meanwhile, as shown in FIGS. 12A and 12B, Japanese Patent Laid-Open Publication No. 63-183391 (1988) discloses a finned heat exchanger in which a plurality of penetrated bulge portions 14*a,* 14*b* and 14*c* are provided on each of opposite faces of each of elongated rectangular fins 11 in order to raise the capability of performing heat exchange. However, in this prior art finned heat exchanger, air flow resistance is large due to the penetrated bulge portions 14*a* to 14*c* of the fin 11, thus resulting in a drop of the capability of performing heat exchange.

Therefore, in order to increase the capability of performing heat exchange for an identical power of air by greatly reducing air flow resistance without unduly lowering the capability of performing heat exchange, Japanese Patent Laid-Open Publication No. 2-217792 (1990) proposes a finned heat exchanger in which a plurality of penetrated bulge portions 14*a,* 14*b* and 14*c* are provided on one face of each of elongated rectangular fins 11 as shown in FIGS. 13A and 13B such that a width of each of the penetrated bulge portions 14*a,* 14*b* and 14*c* is approximately one-third of a lateral interval between the penetrated bulge portions 14*a* to 14*c*.

Namely, heat transfer tubes 13 are, respectively, inserted into fin collars 12 obtained by burring bores arranged at a predetermined interval in a longitudinal direction of the fins 11 in each of the fins 11 as shown in FIGS. 13A and 13B, and air flows between the fins 11 in the direction of the arrow A in FIG. 13B. As shown in FIG. 13A, the fin 11 has the penetrated bulge portions arranged in three columns, i.e., two penetrated bulge portions 14*b* of a first column, one penetrated bulge portion 14*a* of a second column and three penetrated bulge portions 14*c* of a third column are provided between two neighboring heat transfer tubes 13. A width Wf of each of the penetrated bulge portions 14*a* to 14*c* is so set as to be approximately one-third of a lateral interval Wb between the penetrated bulge portions 14*a* to 14*c*.

Meanwhile, in the conventional finned heat exchanger of FIGS. 13A and 13B, if the heat transfer tubes 13 are arranged in a plurality of columns and there is difference in temperature between the refrigerant flowing in one heat transfer tube 13 of one of the columns and that flowing in another heat transfer tube 13 of a corresponding adjacent one of the columns, for example, the refrigerant flowing in at least one of the two neighboring heat transfer tubes 13 is in a state of subcooled liquid or superheated gas, heat exchange is performed between the refrigerants flowing in the neighboring heat transfer tubes 13 through heat conduction via a fin base having a wide flat area. Therefore, even if the heat transfer tubes are arranged in two columns in the fin 11 of FIGS. 13A and 13B, there is substantially no improvement of the capability of performing heat exchange.

SUMMARY OF THE INVENTION

Accordingly, an essential object of the present invention is to provide, with a view to eliminating the above mentioned disadvantages of the prior art, a finned heat exchanger in which by reducing a subcooled liquid range making substantially no contribution to the capability of performing heat exchange in spite of the fact that subcooling is performed sufficiently and by increasing a vapor-liquid two phase range contributing to the capability of performing heat exchange, the capability of performing heat exchange is improved greatly.

Another object of the present invention is to provide a finned heat exchanger in which the capability of performing heat exchange is not lowered even if the condensation temperature is lowered and subcooling is performed sufficiently and in which even if heat transfer tubes are employed in a plurality of columns, heat conduction, through a fin base, between refrigerant flowing in one heat transfer tube of one column and that flowing in another heat transfer tube of a corresponding adjacent one of the columns is restrained, such that the capability of performing heat exchange obtained by the heat transfer tubes arranged in a plurality of the columns is improved effectively.

In order to accomplish these objects of the present invention, a finned heat exchanger according to the present invention comprises: a number of elongated fins which are arranged at a predetermined interval in parallel with one another such that air flows between neighboring ones of the fins in a predetermined direction; and a plurality of heat transfer tubes which contain refrigerant passing therethrough and are orthogonally inserted through the fins so as to be arranged in a plurality of columns on the fins; wherein when the finned heat exchanger is operated for condensation, the heat transfer tubes are provided in two paths in the vicinity of an inlet for the refrigerant and are provided in one path in the vicinity of an outlet for the refrigerant such that the heat transfer tubes of the one path occupy about 5 to 30% of all the heat transfer tubes.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout the several views of the accompanying drawings.

DETAILED DESCRIPTION OF THE INVENTION

Figure 1:
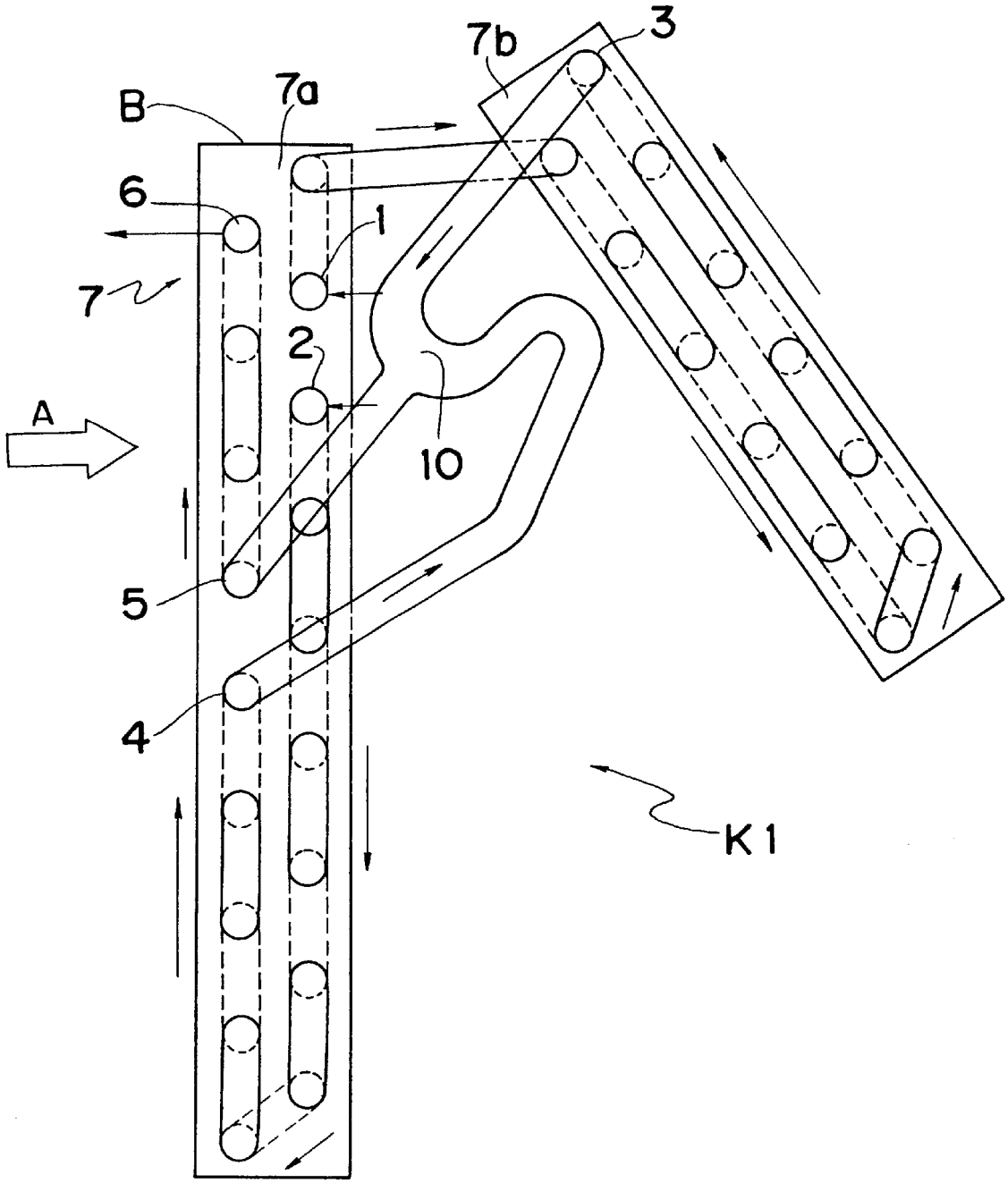
FIG. 1 is a schematic view of a finned heat exchanger according to a first embodiment of the present invention.

Referring now to the drawings, there is shown in FIG. 1, a finned heat exchanger K1 according to a first embodiment of the present invention. The heat exchanger K1 includes a number of elongated rectangular fins 7 arranged at a predetermined interval in parallel with one another such that air flows between neighboring ones of the fins 7 in the direction of the arrow A. Heat transfer tubes 3, 4 and 5 containing refrigerant passing therethrough are orthogonally inserted through the fins 7 so as to be provided in a plurality of, for example, two columns such that the columns of the heat transfer tubes extend substantially perpendicularly to the direction of the arrow A, namely, the columns of the heat transfer tubes are spaced away from each other substantially in the direction of the arrow A. At the time of a condensation operation of the heat exchanger K1, refrigerants flow into two paths from inlet tubes 1 and 2 and flow as shown by the arrows. One refrigerant proceeding from the inlet tube 1 to the heat transfer tube 3 and the other refrigerant proceeding from the inlet tube 2 to the heat transfer tube 4 flow together in the vicinity of a region or position 10 and then, flow in one path from the heat transfer tube 5 so as to flow out of an outlet tube 6 finally.

One path ranging from the heat transfer tube 5 to the outlet tube 6 is disposed at an upstream side of the columns of the heat transfer tubes in the direction of the arrow A. It was found by the present inventors that the heat transfer tubes 5 to 6 of one path may occupy about 5 to 30% of all the heat transfer tubes.

Meanwhile, the inlet tubes 1 and 2 are disposed at a downstream side of the columns of the heat transfer tubes in the direction of the arrow A so as to lie close to the one path ranging from the heat transfer tube 5 to the outlet tube 6. Each of the fins 7 is laterally divided into fin portions 7*a* and 7*b* at a location B. The outlet tube 6 is disposed adjacent to the location B.

By the above described arrangement of the heat exchanger K1, the following effects (1) to (5) can be gained.

(1) The refrigerants flowing into the two paths from the inlet tubes 1 and 2 and proceeding to the heat transfer tubes 3 and 4 flow together in the vicinity of the position 10 and then, flow into one path from the heat transfer tube 5 afterwards so as to flow out of the outlet tube 6 finally at the time of a condensation operation. Since one path is employed in the vicinity of the outlet of the refrigerant at the time of the condensation operation, the liquid refrigerant set in a subcooled state by cooling of air is shifted from the two paths to the one path. Therefore, the area of flow path of the refrigerant decreases. As a result, since the velocity of the refrigerant increases, the heat transfer rate rises greatly. Accordingly, at an identical degree of subcooling, a range of subcooled liquid of the heat exchanger K1, which scarcely contributes to heat exchange is reduced. Consequently, it is possible to increase two phase vapor-liquid range of the heat exchanger K1, which contributes to the capability of performing heat exchange, thereby resulting in a remarkable improvement of capability of performing heat exchange.

(2) Since the one path ranging from the heat transfer tube 5 to the outlet tube 6 is disposed at an upstream side of the columns of the heat transfer tubes in the direction of the arrow A, a portion of the refrigerant, which is set at low temperature by subcooling at the time of the condensation operation, is disposed at the upstream side of the columns of the heat transfer tubes in the direction of the arrow A. Therefore, in case the refrigerant is caused to flow into the two paths in opposite directions, the temperature gradient of the refrigerant increases, so that the effects of the refrigerant are enhanced, thereby resulting in an improvement of the capability of performing heat exchange.

(3) Since the two inlet tubes 1 and 2 are disposed at a downstream side of the columns of the heat transfer tubes in the direction of the arrow A, the superheated refrigerant which reaches the highest temperature during the condensation operation is disposed at the downstream side of the columns of the heat transfer tubes in the direction of the arrow A. Therefore, in case the refrigerant is caused to flow into the two paths in opposite directions, the temperature gradient of the refrigerant increases, so that effects of the refrigerant are enhanced, thus resulting in improvement of the capability of performing heat exchange.

(4) The one path ranging from the heat transfer tube 5 to the outlet tube 6 is disposed at the upstream side of the columns of the heat transfer tubes in the direction of the arrow A and the inlet tubes 1 and 2 are disposed at the downstream side of the columns of the heat transfer tubes in the direction of the arrow A so as to lie close to the one path ranging from the heat transfer tube 5 to the outlet tube 6. Therefore, the portion of the refrigerant, which has the highest temperature, and the low-temperature portion of the refrigerant lie close to each other. Accordingly, if the refrigerant is caused to flow into the two paths in opposite directions, the temperature gradient of the refrigerant increases, so that the effects of the refrigerant are enhanced, thereby resulting in improvement of the capability of performing heat exchange.

(5) Since each of the fins 7 is laterally divided into the fin portions 7*a* and 7*b* at the location B and the outlet tube 6 is disposed adjacent to the location B, the outlet tube 6 which has the lowest temperature in the heat exchanger K1 and the high-temperature heat transfer tube 3 are provided on the fin portions 7*a* and 7*b*, respectively and thus, are separated from each other. Accordingly, since heat exchange due to heat conduction between the outlet tube 6 and the heat transfer tube 3 is prevented, loss in the heat exchanger K1 is reduced, thus resulting in remarkable improvement of the capability of performing heat exchange.

Figure 9A:
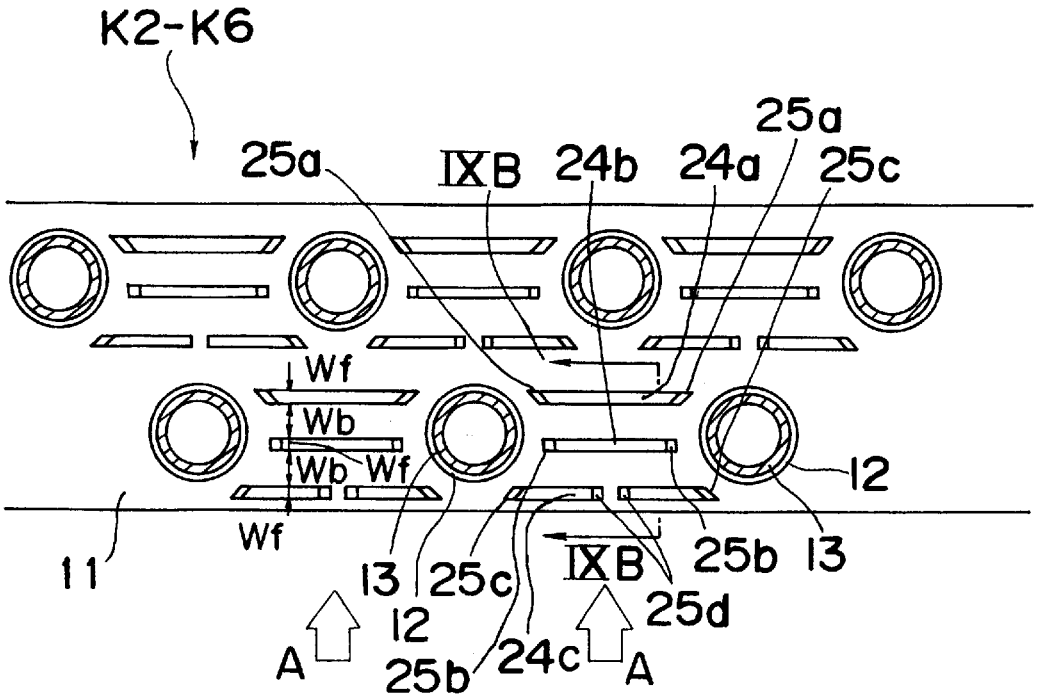
FIG. 9A is a top plan view showing an arrangement of a fin of the finned heat exchangers according to the second to sixth embodiments of the present invention.
Figure 9B:
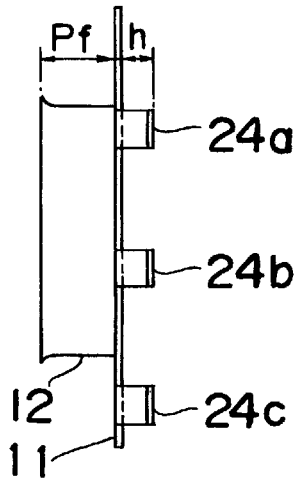
FIG. 9B is a sectional view taken along the line IXB—IXB in FIG. 9A.

Hereinafter, an arrangement common in finned heat exchangers K2 to K6 is described with reference to FIGS. 9A, 9B and 10. As shown in FIGS. 9A and 9B, each of the heat exchangers K2 to K6 includes a number of elongated rectangular fins 11 arranged at a predetermined interval in parallel with one another such that air flows between neighboring ones of the fins 11 in the direction of the arrows A. Heat transfer tubes 13 are, respectively, inserted into fin collars 12 obtained by burring bores arranged at a predetermined interval in a longitudinal direction of the fins 11 in two columns in each of the fins 11. Between neighboring ones of the heat transfer tubes 13 in the longitudinal direction of the fins 11 in each of the columns of the bores, a group of penetrated bulge portions arranged in three columns, i.e., a penetrated bulge portion 24*a* of a first column, a penetrated bulge portion 24*b* of a second column and two penetrated bulge portions 24*c* of a third column are provided on one face of each of the fins 11, for example, one face of each of the fins 11 opposite to the fin collars 12. Therefore, when the penetrated bulge portions are laterally arranged in a plurality of columns from a centerline between the longitudinally neighboring heat transfer tubes 13, the number of the penetrated bulge portions of a first column closest to the centerline is a minimum and the number of the penetrated bulge portions of one column is so set as to be equal to or gradually larger than the minimum as the column is spaced farther from the centerline. A width Wf of each of the penetrated bulge portions 24*a* to 24*c* is so set as to be approximately one-third to a half of a lateral interval Wb between the penetrated bulge portions 24*a* to 24*c*. A height h of the penetrated bulge portions 24*a* to 24*c* is so set as to approximately range from a half to two-thirds of a height Pf of the fin collars 12, i.e., an interval between the fins 11. The penetrated bulge portion 24*a* has a pair of legs 25*a* and the penetrated bulge portion 24*b* has a pair of legs 25*b*. Meanwhile, each of the penetrated bulge portions 24*c* has legs 25*c* and 25*d*. Each of the legs 25*a*, each of the legs 25*b* and the leg 25*c* which confront each of the neighboring heat transfer tubes 13, are arranged in such a direction and at such a position as to extend substantially along an outerperiphery of each of the neighboring heat transfer tubes 13. The leg 25*d* of each of the penetrated bulge portions 24*c*, which is remote from each of the neighboring heat transfer tubes 13, is so formed as to extend substantially in the direction of the arrow A.

Figure 10:
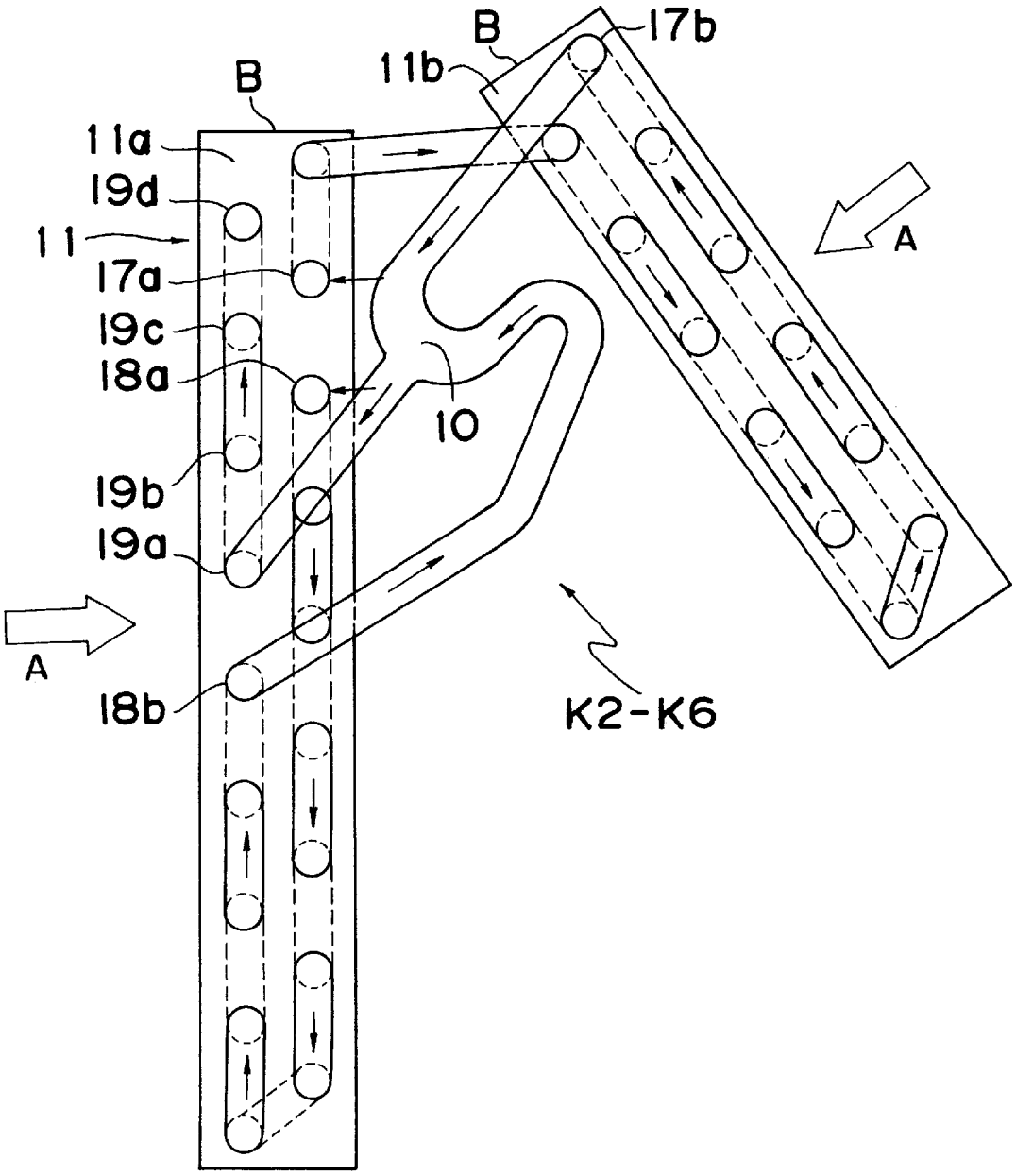
FIG. 10 is a front elevational view showing an arrangement of a refrigerant flow path of the finned heat exchangers according to the second to sixth embodiments of the present invention.
Figure 11:
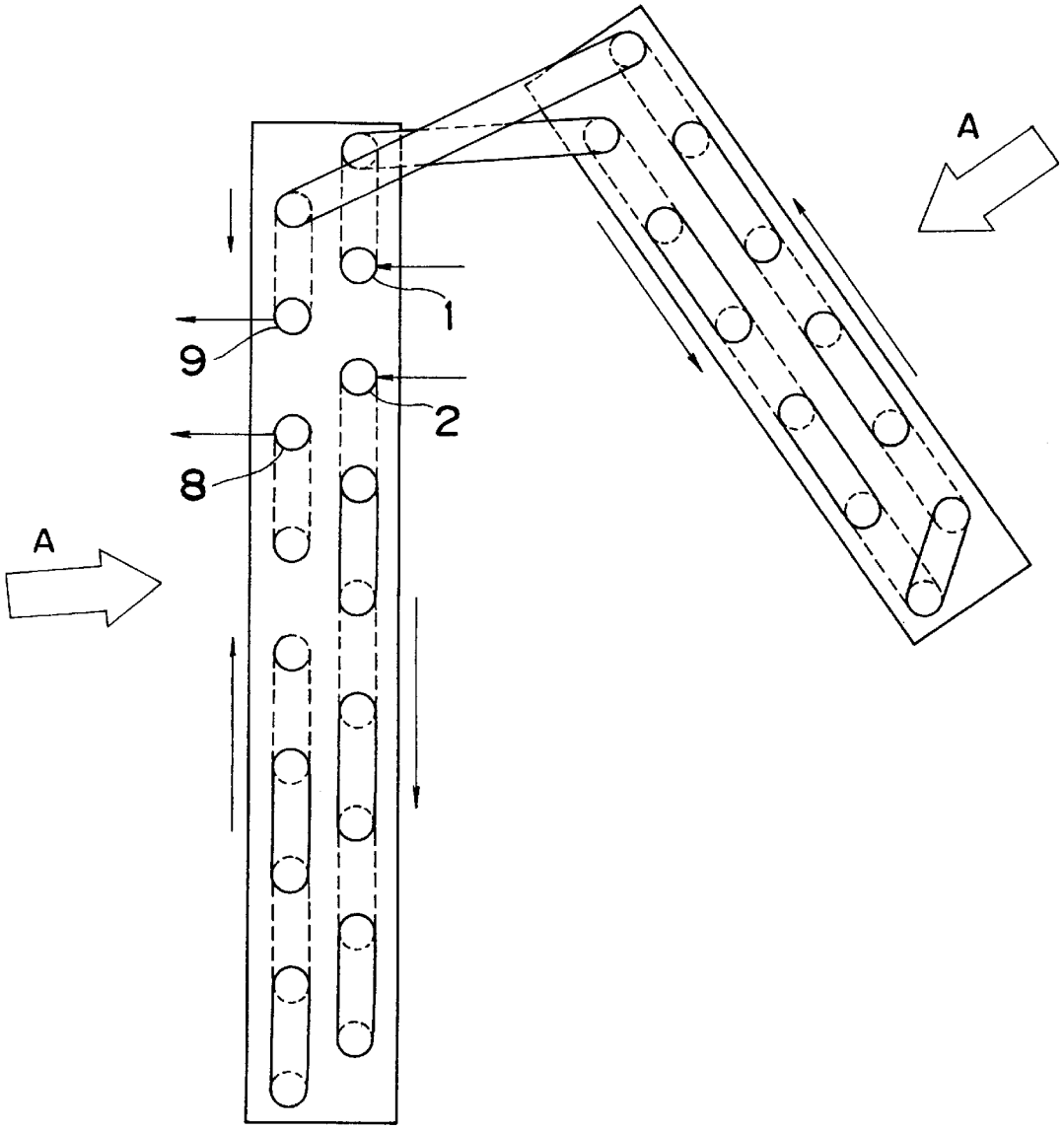
Fig.11 PRIOR ART
FIG. 11 is a schematic view of a prior art finned heat exchanger (already referred to)
Figure 12A:
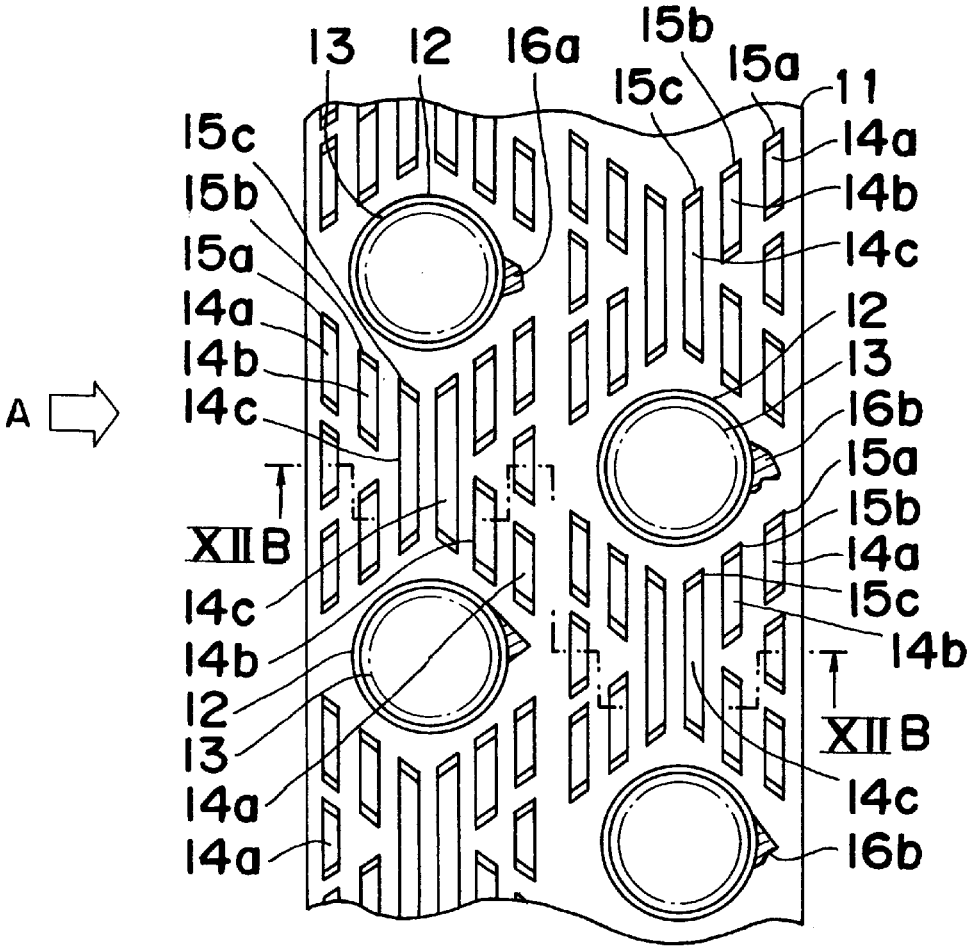
Fig. 12A PRIOR ART
FIG. 12A is a top plan view of another prior art finned heat exchanger (already referred to)
Figure 12B:
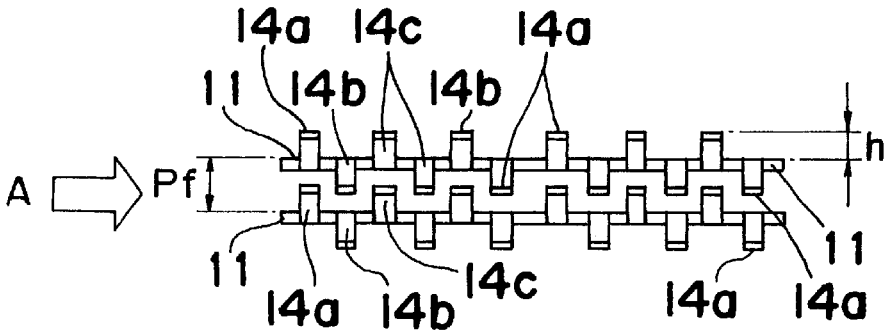
Fig. 12B PRIOR ART
FIG. 12B is a sectional view taken along the line XIIB—XIIB in FIG. 12A (already referred to)
Figure 13A:
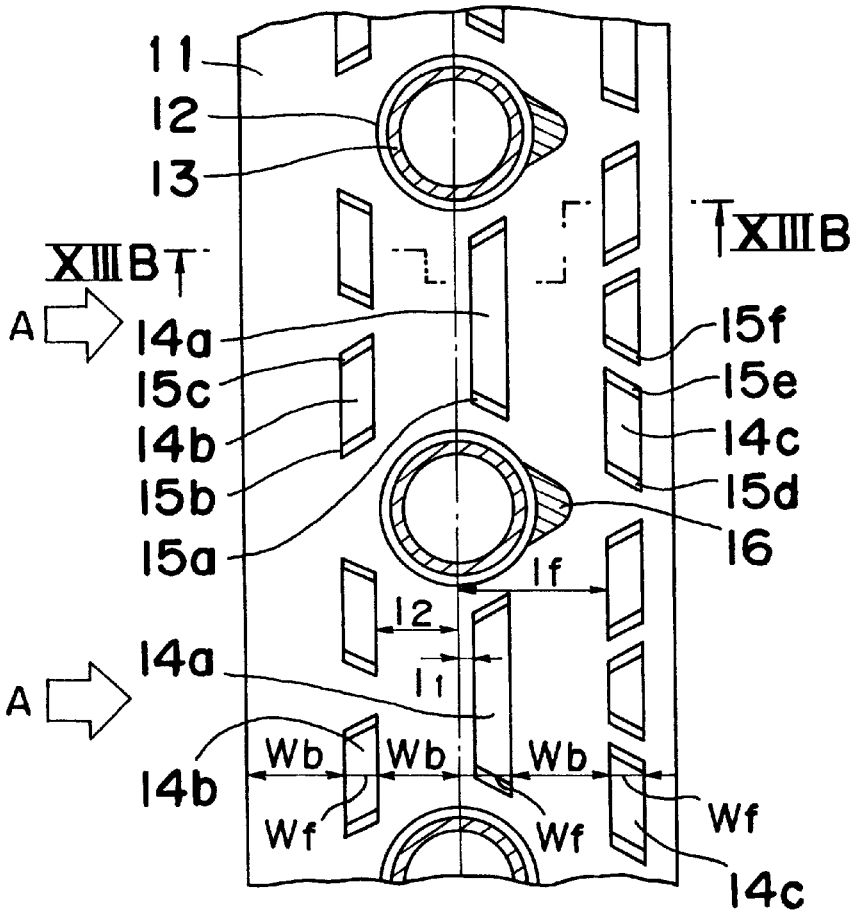
Fig. 13A PRIOR ART
FIG. 13A is a top plan view of still another prior art finned heat exchanger (already referred to)
Figure 13B:
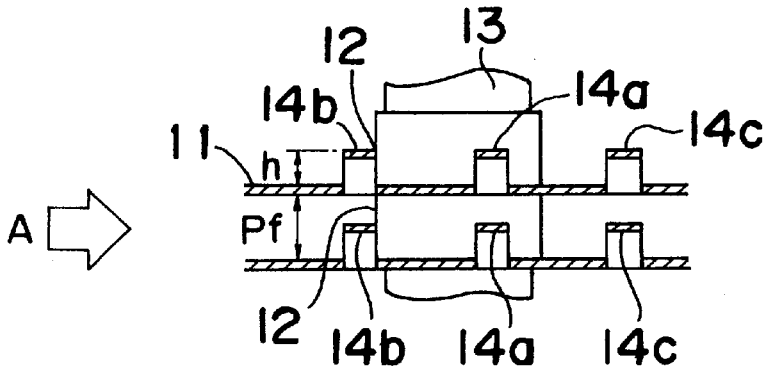
Fig. 13B PRIOR ART
FIG. 13B is a sectional view taken along the line XIIIB—XIIIB in FIG. 13A.

FIG. 10 shows an arrangement of a flow path of refrigerant in the heat exchangers K2 to K6. Each of the fins 11 has the fin collars 12 arranged in two columns and the number of the fin collars 12 of each of the columns is 15. Each of the fins 11 is laterally divided into fin portions 11*a* and 11*b* at a location B. When each of the heat exchangers K2 to K6 is used as a condenser, refrigerants in a superheated gaseous state flow into two paths from heat transfer tubes 17*a* and 18*a* disposed at a downstream side of the columns of the fin collars 12 in the direction of the arrow A and flow through heat exchange in the directions of the arrows. After passing through heat transfer tubes 17*b* and 18*b* where subcooling starts, the refrigerants flow together in the vicinity of a position 10 into one flow path and then, flow from a heat transfer tube 19*a* to a heat transfer tube 19*c* via a heat transfer tube 19*b* while being further cooled so as to flow out of a heat transfer tube 19*d* finally. The heat transfer tubes 19*a* to 19*d* are disposed at an upstream side of the columns of the fin collars 12 in the direction of the arrow A.

Namely, among a total of the 30 heat transfer tubes, the four heat transfer tubes 19*a* to 19*d* are disposed in one flow path so as to occupy about 13% (=4/30) of a total of the 30 heat transfer tubes, while the remaining heat transfer tubes are disposed in two flow paths. It was found by the present inventors that the heat transfer tubes 19*a* to 19*d* of the one flow path may occupy about 5 to 30% of all the heat transfer tubes.

The heat transfer tubes 19*a* to 19*d* are disposed at the upstream side of the columns of the fin collars 12 in the direction of the arrow A and the heat transfer tube 19*d* acting as an outlet of the refrigerant is disposed adjacent to the location B dividing the fin 11 into the fin portions 11*a* and 11*b*. On the other hand, the heat transfer tubes 17*a* and 18*a* acting as inlets of the refrigerant are disposed downstream of the heat transfer tubes 19*a* to 19*d* in the direction of the arrow A.

Figure 2:
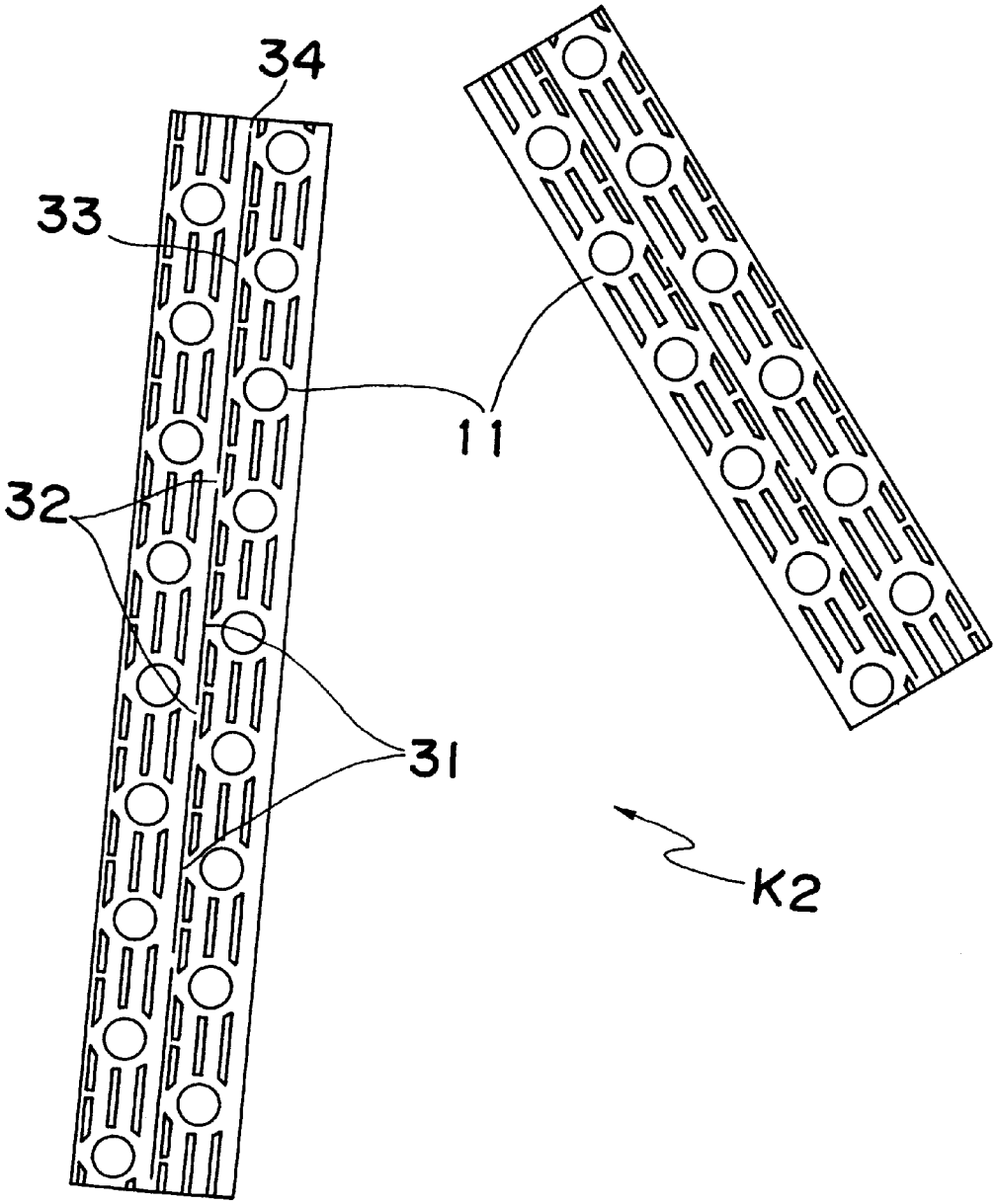
FIG. 2 is a top plan view of a finned heat exchanger according to a second embodiment of the present invention.

FIG. 2 shows the fin 11 of the heat exchanger K2. A plurality of cut portions 31 and 33 formed by slits having substantially no width or cutouts having a small width extend longitudinally substantially along a centerline between the columns of the fin collars 12 in the fin 11. A length of each of the cut portions 31 and 33 is so set as to be not less than a diameter of each of the heat transfer tubes 13 but not more than approximately five to six times a longitudinal interval of the heat transfer tubes 13. The cut portions 31 and 33 extend longitudinally throughout the fin 11 in alignment with each other via noncut portions 32. A length of each of the noncut portions 32 is so set as to be not more than about a half of a diameter of the heat transfer tubes 13.

More specifically, in the heat exchanger K2, a sum of the length of the cut portion 31 and that of the noncut portion 32 is so set as to be twice the longitudinal interval of the heat transfer tubes 13, while a sum of the length of the cut portion 33 and that of the noncut portion 32 is equal to three times the longitudinal interval of the heat transfer tubes 13. Since the number of the heat transfer tubes 13 of one column is 15 but the fin 11 includes opposite edge portions having a total length equal to one longitudinal interval of the heat transfer tubes 13 from centers of the two heat transfer tubes 13 disposed at opposite ends of the fin 11, respectively, the fin 11 has a length equal to a total of 15 (=14+1) longitudinal intervals of the heat transfer tubes 13. Therefore, the fin 11 has the six cut portions 31 corresponding to the 12 (=6×2) longitudinal intervals of the heat transfer tubes 13 and only one cut portion 33 corresponding to the three longitudinal intervals of the heat transfer tubes 13, i.e., 12+3=15.

An end 34 of the cut portion 33 lies close to the location B adjacent to the heat transfer tube 19*d*. The cut portion 33 longer than the cut portions 31 is disposed downstream of the heat transfer tubes 19*a* to 19*d* in the direction of the arrow A.

Figure 3:
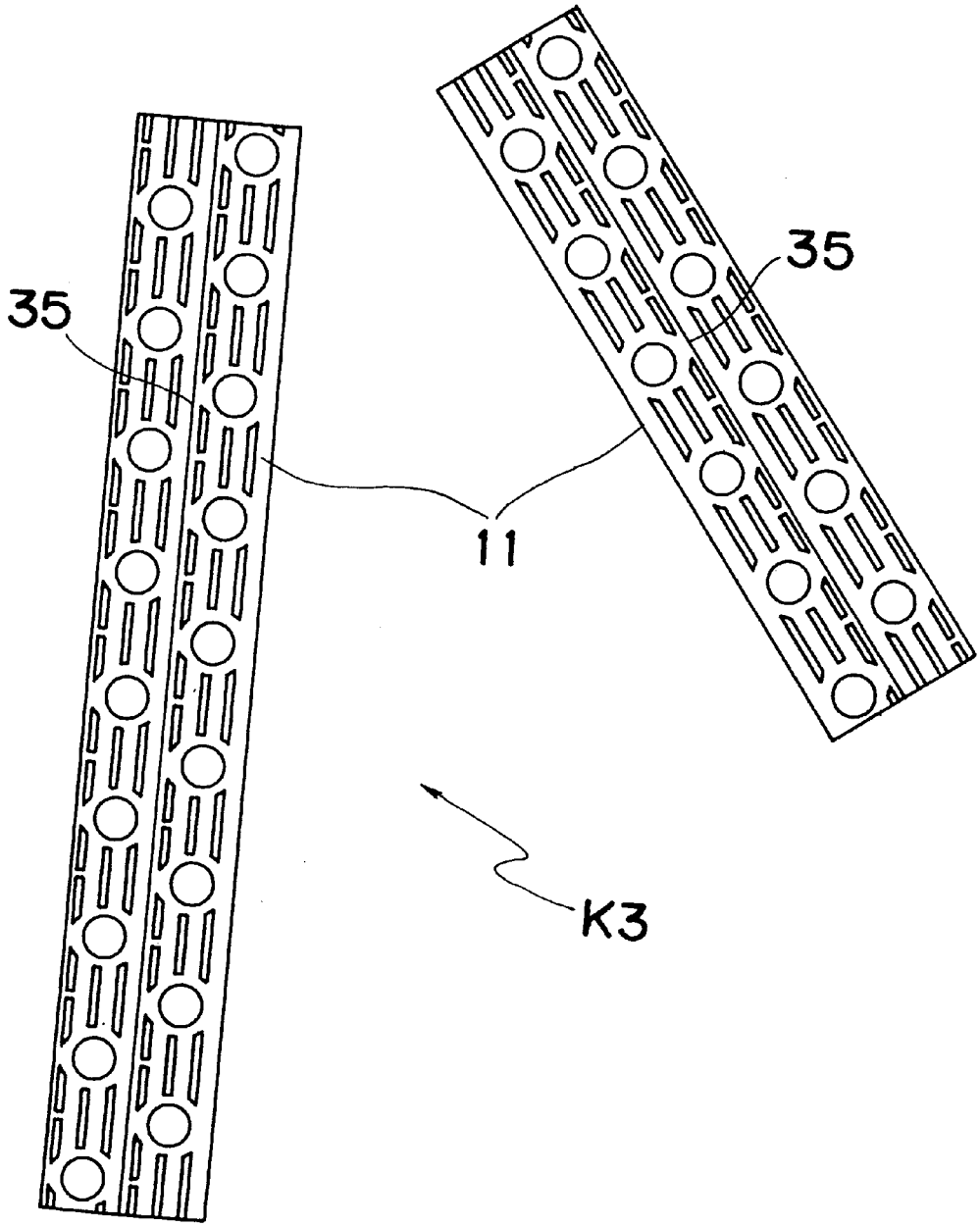
FIG. 3 is a top plan view of a finned heat exchanger according to a third embodiment of the present invention.

FIG. 3 shows the fin 11 of the heat exchanger K3. The fin 11 is longitudinally split into two halves along a line 35.

Figure 4:
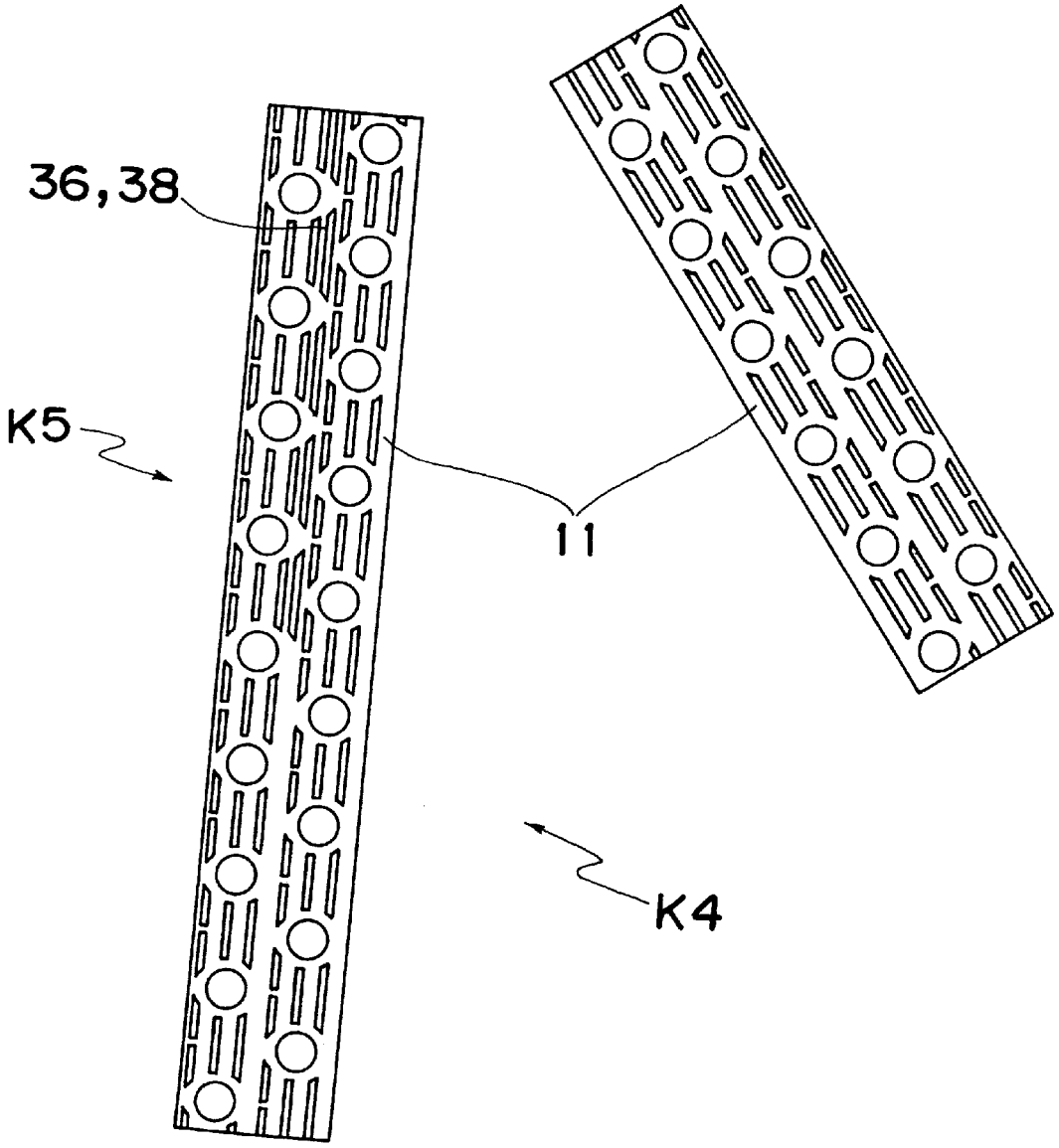
FIG. 4 is a top plan view of finned heat exchangers according to fourth and fifth embodiments of the present invention.
Figure 5A:
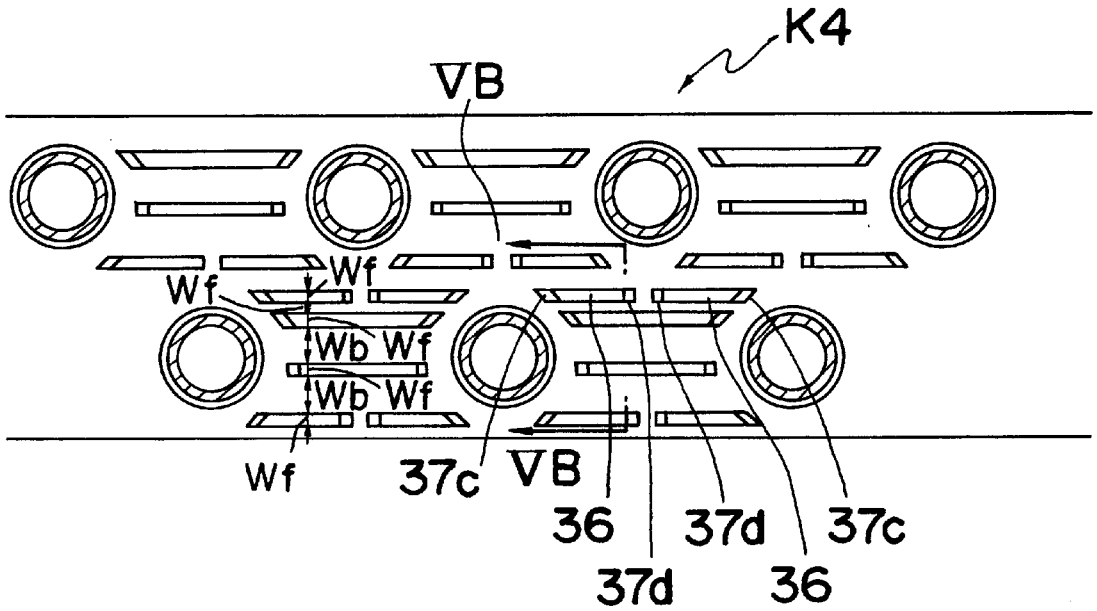
FIG. 5A is a detailed top plan view of the finned heat exchanger of FIG. 4 according to the fourth embodiment of the present invention.
Figure 5B:
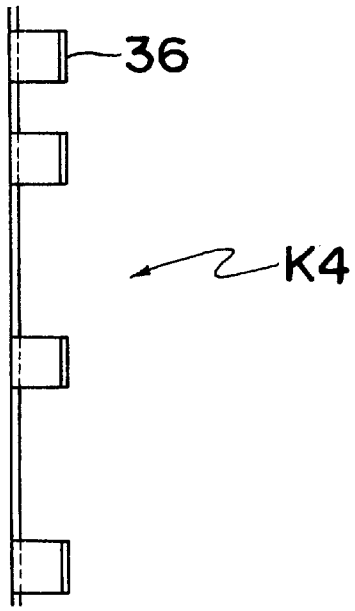
FIG. 5B is a sectional view taken along the line VB—VB in FIG. 5A.

Hereinafter, the fin 11 of the heat exchanger K4 is described with reference to FIGS. 4, 5A and 5B. Two penetrated bulge portions 36 having the height h equal to approximately one half to two-thirds of the height Pf of the fin collars 12 and each having the width Wf of the penetrated bulge portions 24*a* to 24*c* are provided on one face of the fin 11 identical with that having the penetrated bulge portions 24*a* to 24*c*. Assuming that the refrigerant in the subcooled liquid state or superheated gaseous state passes through the heat transfer tubes 13 of one column, each of the penetrated bulge portions 36 is provided in the vicinity of a central portion between the heat transfer tube 13 of one column and a neighboring one of the heat transfer tubes 13 of the other column. Each of the penetrated bulge portions 36 has a leg 37*c* adjacent to the heat transfer tube 13 of the other column and a leg 37*d* remote from the heat transfer tube 13 of the other column. The leg 37*c* is arranged in such a direction and at such a position as to extend substantially along an outer periphery of the heat transfer tube 13 of the other column, while the leg 37*d* extends substantially in the direction of the arrow A.

Figure 6A:
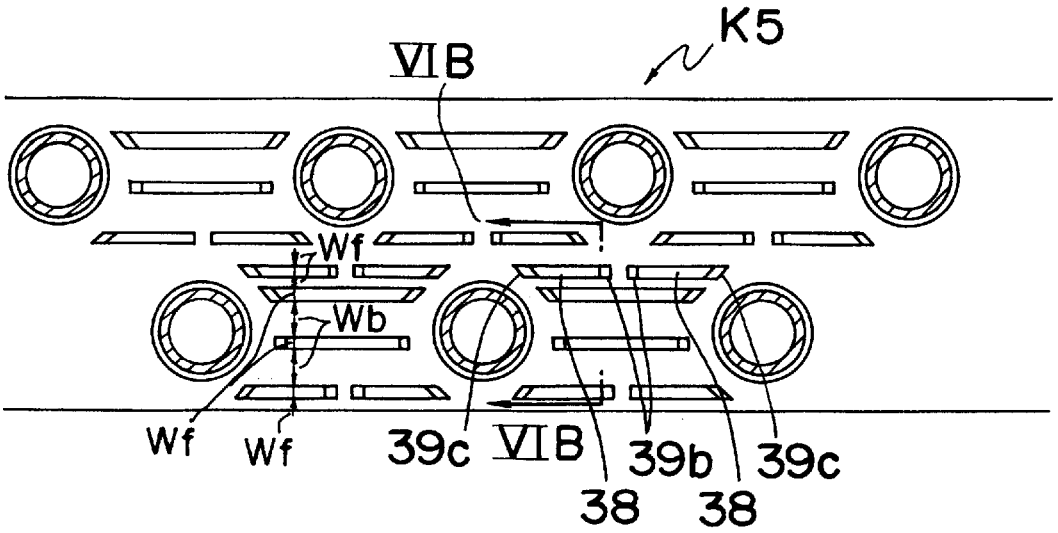
FIG. 6A is a detailed top plan view of the finned heat exchanger of FIG. 4 according to the fifth embodiment of the present invention.
Figure 6B:
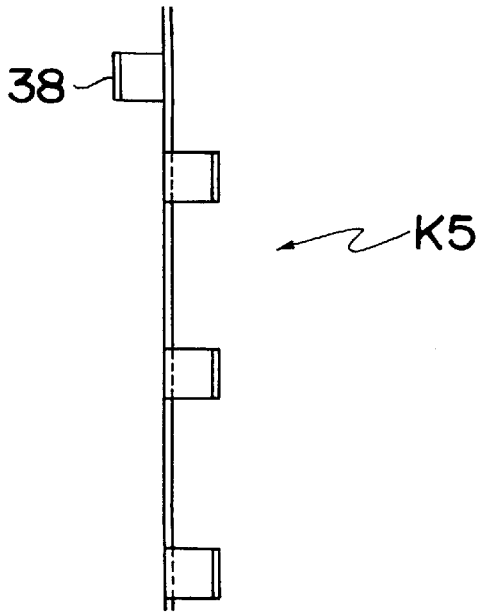
FIG. 6B is a sectional view taken along the line VIB—VIB in FIG. 6A.

Hereinafter, the fin 11 of the heat exchanger K5 is described with reference to FIGS. 4, 6A and 6B. Two penetrated bulge portions 38 having the height h equal to approximately a half to two-thirds of the height Pf of the fin collars 12 and each having the width Wf of the penetrated bulge portions 24*a* to 24*c* are provided on one face of the fin 11 opposite to the penetrated bulge portions 24*a* to 24*c*. Assuming that the refrigerant in the subcooled liquid state or superheated gaseous state passes through the heat transfer tubes 13 of one column, each of the penetrated bulge portions 38 is provided in the vicinity of a central portion between the heat transfer tube 13 of one column and a neighboring one of the heat transfer tubes 13 of the other column. Each of the penetrated bulge portions 38 has a leg 39*c* adjacent to the heat transfer tube 13 of the other column and a leg 39*d* remote from the heat transfer tube 13 of the other column. The leg 39*c* is arranged in such a direction and at such a position as to extend substantially along an outer periphery of the heat transfer tube 13 of the other column, while the leg 37*d* extends substantially in the direction of the arrow A.

Figure 7:
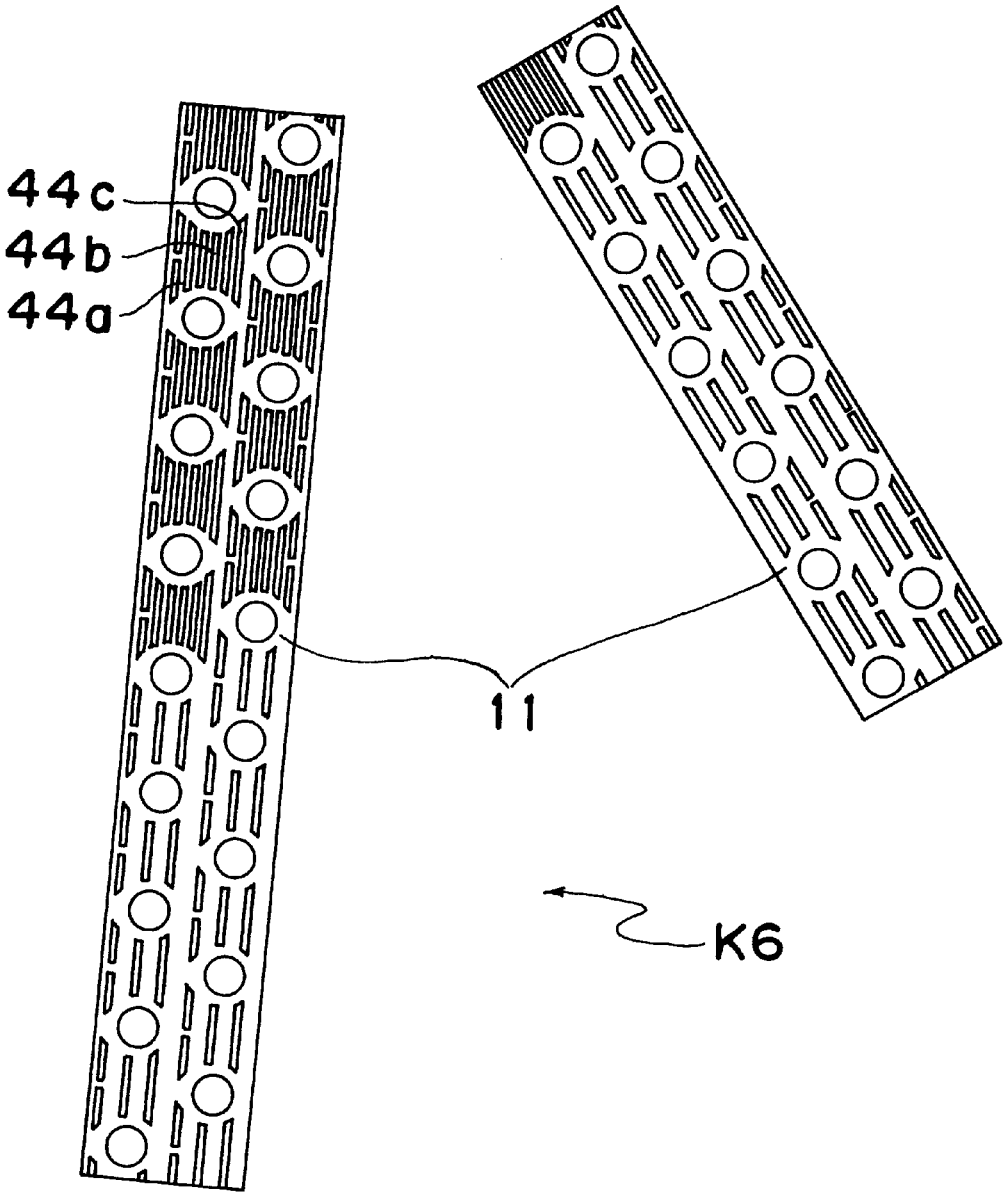
FIG. 7 is a top plan view of a finned heat exchanger according to a sixth embodiment of the present invention.
Figure 8A:
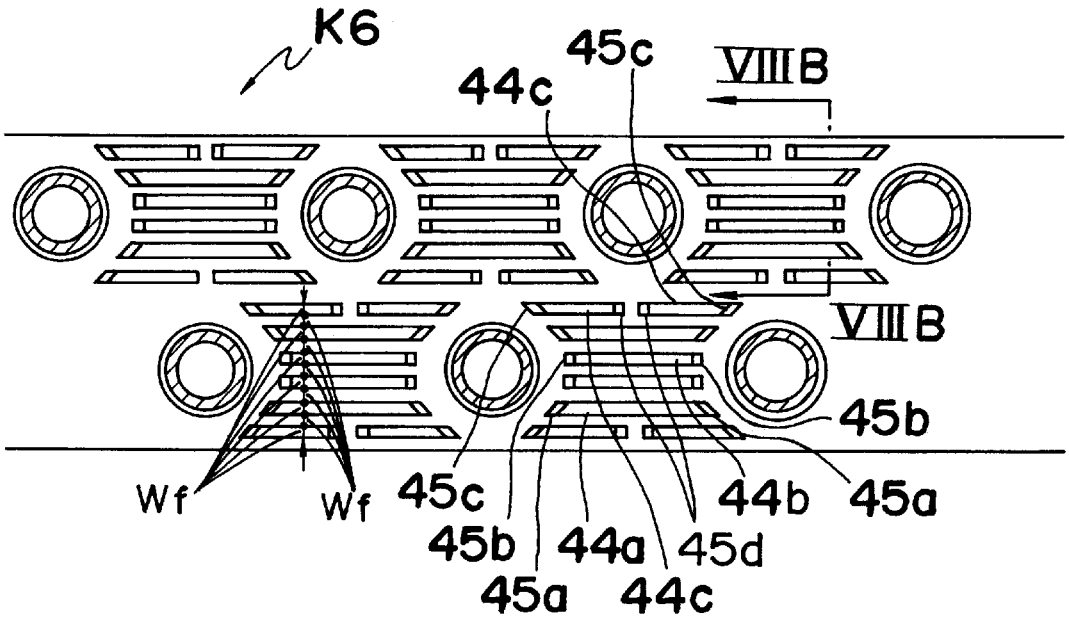
FIG. 8A is a detailed top plan view of the finned heat exchanger of FIG. 7.
Figure 8B:
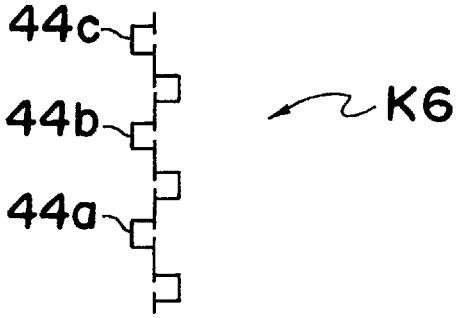
FIG. 8B is a sectional view taken along the line VIIIB—VIIIB in FIG. 8A.

The heat exchanger K6 is described with reference to FIGS. 7, 8A and 8B, hereinafter. One penetrated bulge portion 44*a*, one penetrated bulge portion 44*b* and two penetrated bulge portions 44*c* each having the height h equal to approximately a half to two-thirds of the height Pf of the fin collars 12 and having the width Wf of the penetrated bulge portions 24*a* to 24*c* are provided on one face of the fin 11 opposite to the penetrated bulge portions 24*a* to 24*c* so as to be disposed in the vicinity of the heat transfer tube 13 containing the refrigerant in the subcooled liquid state or superheated gaseous state passing therethrough. The penetrated bulge portions 44*a*, 44*b* and 44*c* and the penetrated bulge portions 24*a*, 24*b* and 24*c* are provided laterally alternately on the opposite faces of the fin 11 such that a corresponding one of the penetrated bulge portions 44*a* to 44*c* lies at a center between neighboring ones of the penetrated bulge portions 24*a* to 24*c*. The penetrated bulge portion 44*a* has a pair of legs 45*a* each confronting the heat transfer tube 13, the penetrated bulge portion 44*b* has a pair of legs 45*b* each confronting the heat transfer tube 13 and each of the penetrated bulge portions 44*c* has a leg 45*c* confronting the heat transfer tube 13 and a leg 45*d* remote from the heat transfer tube 13. The legs 45*a*, 45*b* and 45*c* are arranged in such a direction and at such positions as to extend substantially along an outer periphery of the heat transfer tube 13. On the other hand, the leg 45*d* of each of the penetrated bulge portions 44*c* extends substantially in the direction of the arrow A.

Meanwhile, in the heat exchangers K4 to K6, the penetrated bulge portions 36, 38 and 44*a* to 44*c* are provided in the vicinity of the heat transfer tube 13 containing the refrigerant in a subcooled liquid state or superheated gaseous state passing therethrough but may also be provided in any region of the fin 11.

By the above described arrangements of the heat exchangers K2 to K6, the following effects (1) to (17) can be gained.

(1) In the heat exchangers K2 to K6, a plurality of the penetrated bulge portions 24*a* to 24*c* are provided between neighboring ones of the heat transfer tubes 13 in the longitudinal direction of the fin 11 on only one face of the fin 11 and the width Wf of each of the penetrated bulge portions 24*a* to 24*c* is so set as to be about one third to a half of the lateral interval Wb between the penetrated bulge portions 24*a* to 24*c*. The fin 11 is laterally divided into the fin portions 11*a* and 11*b* at the location B and the heat transfer tubes 13 containing the refrigerant passing therethrough are inserted through the fins 11. When the heat exchanger K2 is used as a condenser, the heat transfer tubes 19*a* to 19*d* acting as the outlet for the refrigerant are provided in one flow path so as to occupy about 5 to 30% of all the heat transfer tubes, while the remaining heat transfer tubes are provided in two flow paths. The heat transfer tubes 19*a* to 19*d* of one flow path are provided at the most upstream one of the columns of the heat transfer tubes in the direction of the arrow A and the heat transfer tube 19*d* acting as the outlet for the refrigerant is disposed adjacent to the location B dividing the fin 11 into the fin portions 11*a* and 11*b*. Meanwhile, the heat transfer tubes 17*a* and 18*a* acting as the inlets for the refrigerant are disposed downstream of the heat transfer tubes 19*a* to 19*d* of one flow path in the direction of the arrow A or in the vicinity of the heat transfer tubes 19*a* to 19*d* at the most downstream one of the columns of the heat transfer tubes in the direction of the arrow A. When the refrigerant in a subcooled liquid state or superheated gaseous state passes through one heat transfer tube of one column, a heat insulation means is provided in the vicinity of a central portion between the one heat transfer tube and a neighboring one of the heat transfer tubes of the other column on one face of the fin 11.

By the above described arrangement of the heat exchangers K2 to K6, the heat transfer tubes containing the refrigerant in a subcooled liquid state passing therethrough are provided in one flow path. Therefore, even if the condensation temperature is set low and the degree of subcooling is increased, the rate of heat transfer can be raised greatly without incurring much increase of flow resistance of the refrigerant, and heat exchange from the heat transfer tube 19*d* of one column to the neighboring heat transfer tube of the other column through the fin 11 through heat conduction can be reduced substantially.

The heat transfer tubes 19*a* to 19*d* containing the refrigerant in a subcooled liquid state passing therethrough are provided in one flow path and are disposed at the most upstream one of the columns of the heat transfer tubes and the heat transfer tubes 17*a* and 18*a* containing the refrigerant in a superheated gaseous state passing therethrough are disposed downstream of the heat transfer tubes 19*a* to 19*d* or in the vicinity of the heat transfer tubes 19*a* to 19*d* at the most downstream one of the columns of the heat transfer tubes. Therefore, by causing the refrigerants to flow in opposite directions, the capability of performing heat exchange can be improved. By the heat insulation means provided at the central portion between the neighboring heat transfer tubes in the lateral direction of the fin 11, i.e., in the direction of the arrow A on the fin 11, a phenomenon that heat conduction between the refrigerants flowing through the neighboring heat transfer tubes, respectively is performed via the fin base is restrained, so that it is possible to upgrade the capability of performing heat exchange among the heat transfer tubes arranged in a plurality of the columns.

(2) In the heat exchanger K2, the cut portions 31 and 33 extending in the longitudinal direction of the fin 11 are provided as the heat insulation means. By this arrangement, it is possible to restrain a phenomenon that heat conduction between the refrigerants flowing through the laterally neighboring heat transfer tubes 13 takes place via the fin base and the performance of heat transfer can be upgraded by the leading edge effect of a thermal boundary layer, which effect is gained by the cut portions 31 and 33.

(3) In the heat exchanger K2, the length of the cut portions 31 and 33 is so set as to be not less than the diameter of the heat transfer tubes 13 but not more than about five to six times the longitudinal interval between the heat transfer tubes 13. By this arrangement, it is possible to effectively restrain a phenomenon that heat conduction between the refrigerants flowing through the laterally neighboring heat transfer tubes 13 occurs via the fin base.

(4) In the heat exchanger K2, the end 34 of the cut portion 33 lies close to the location B adjacent to the heat transfer tube 19*d*. By this arrangement, since the cut portions 31 and 33 securely exist between the heat transfer tube 19*d* acting as the outlet for the refrigerant having the lowest temperature and the laterally neighboring heat transfer tube 13, heat conduction between the laterally neighboring heat transfer tubes 13 via the fin base can be restrained most effectively.

(5) In the heat exchanger K2, a plurality of the cut portions 31 and 33 extend in alignment with each other in the longitudinal direction of the fin 11 between the noncut portions 32. By this arrangement, the heat transfer performance can be further upgraded by leading edge effect a of thermal boundary layer, which effect is achieved by the cut portions 31 and 33.

(6) In the heat exchanger K2, a plurality of the cut portions 31 and 33 extend in alignment with each other in the longitudinal direction of the fin 11 between the noncut portions 32 from one end portion to the other end portion of the fin 11. By this arrangement, the heat transfer performance can be further upgraded by leading edge effect of the thermal boundary layer, which effect is achieved by the cut portions 31 and 33.

(7) In the heat exchanger K2, the length of each of the noncut portions 32 is so set as to be not more than about the half of the diameter of the heat transfer tubes 13. By this arrangement, it is possible to restrain a phenomenon that heat conduction between the refrigerants flowing through the laterally neighboring heat transfer tubes 13 occurs via the noncut portions 32 so as to lower the capability of performing heat exchange.

(8) In the heat exchanger K2, the length of each of the cut portions 31 and the length of each of the noncut portions 32 are set substantially uniformly. If a remainder is produced when an overall length of the fin 11 is divided by the sum of the length of each of the cut portions 31 and the length of each of the noncut portions 32, the length of the single cut portion 33 is so set as to be larger than that of each of the cut portions 31 by a length corresponding to such remainder. By this arrangement, in case the fins 11 are subjected to working by repeatedly using a die for the cut portions 31 having the uniform length, the fins 11 are punched two times at only one location of the fins 11 by shifting in the longitudinal direction of the fins 11 through a distance corresponding to the remainder, so that the cut portion 33 longer than each of the cut portions 31 by the remainder can be obtained. As a result, it is easily possible to obtain the fins 11 in which the cut portions 31 and 33 extend in alignment with each other in the longitudinal direction of the fins 11 between the noncut portions 32 from one end of the fins 11 to the other end of the fins 11.

(9) In the heat exchanger K2, the heat transfer tubes 19*a* to 19*d* acting as the outlet for the refrigerant are provided in one flow path and the cut portion 33 longer than each of the cut portions 31 is disposed in the vicinity of and downstream of the heat transfer tubes 19*a* to 19*d* in the direction of the arrow A. By this arrangement, it is possible to effectively perform heat insulation between the heat transfer tubes 19*a* to 19*d* containing the refrigerant in a subcooled liquid state passing therethrough and the laterally neighboring heat transfer tubes 13.

(10) In the heat exchanger K3, the fin 11 is longitudinally split into two halves along the line 35 acting as the heat insulation means. By this arrangement, it is possible to restrain a phenomenon that heat conduction occurs between the refrigerants flowing through the laterally neighboring heat transfer tubes 13 via the fin base and the heat transfer performance can be upgraded by leading edge effect of a thermal boundary layer, which effect is brought about by the line 35.

(11) In the heat exchanger K4, the penetrated bulge portions 36 each having the width Wf of the penetrated bulge portions 24*a* to 24*c* are provided as the heat insulation means on one face of the fin 11 identical with that having the penetrated bulge portions 24*a* to 24*c*. By this arrangement, it is possible to restrain a phenomenon that heat conduction occurs between the refrigerants flowing through the laterally neighboring heat transfer tubes 13 via the fin base and the heat transfer performance can be upgraded by the leading edge effect of the thermal boundary layer, which effect is achieved by the penetrated bulge portions 36. Since all the penetrated bulge portions 24*a* to 24*c* and 36 are provided on an identical face of the fin 11, maintenance and service of a die for the fin 11 can be performed easily.

(12) In the heat exchanger K5, the penetrated bulge portions 38 each having the width Wf of the penetrated bulge portions 24*a* to 24*c* are provided as the heat insulation means on one face of the fin 11 opposite to the penetrated bulge portions 24*a* to 24*c*. By this arrangement, it is possible to restrain a phenomenon that heat conduction occurs between the refrigerants flowing through the laterally neighboring heat transfer tubes 13 via the fin base and the heat transfer performance can be upgraded by the leading edge effect of the thermal boundary layer, which effect is gained by the penetrated bulge portions 38. A die for the fin 11 can be easily obtained by modifying a die for the fin 11 in which a plurality of the penetrated bulge portions are provided alternately on the opposite faces of the fin 11.

(13) In the heat exchanger K6, a plurality of the penetrated bulge portions 44*a* to 44*c* each having the width Wf of the penetrated bulge portions 24*a* to 24*c* are provided as the heat insulation means on one face of the fin 11 opposite to the penetrated bulge portions 24*a* to 24*c* such that the penetrated bulge portions 44*a* to 44*c* and the penetrated bulge portions 24*a* to 24*c* are disposed laterally alternately on the opposite faces of the fin 11. A corresponding one of the penetrated bulge portions 44*a* and 44*b* is disposed at a center between neighboring ones of the penetrated bulge portions 24*a* to 24*c*. By this arrangement, it is possible to restrain a phenomenon that heat conduction occurs between the refrigerants flowing through the laterally neighboring heat transfer tubes 13 via the fin base and the heat transfer performance can be upgraded by the leading edge effect of the thermal boundary layer, which effect is gained by the penetrated bulge portions 24*a* to 24*c* and 44*a* to 44*c*.

(14) In the heat exchangers K2–K6, the penetrated bulge portions 24*a* to 24*c*, 36, 38 and 44*a* to 44*c* have the height h equal to approximately a half to two-thirds of the height Pf of the fin collars 12. By this arrangement, the velocity distribution of air between the fins 11 is uniform and an increase of air flow resistance of air can be reduced.

(15) In the heat exchangers K2 to K6, when the penetrated bulge portions 24*a* to 24*c*, 36, 38 and 44*a* to 44*c* are laterally arranged in a plurality of columns from the centerline between the longitudinally neighboring heat transfer tubes 13, the number of the penetrated bulge portions of a first column closest to the centerline is a minimum and the number of the penetrated bulge portions of the remaining ones of the columns is so set as to be equal to or gradually larger than the minimum as the remaining ones of the columns are spaced farther from the centerline. By this arrangement, the local velocity distribution of air at a downstream portion in the direction of the arrow A is least likely to happen and thus, an increase of noise of air flow can be reduced.

(16) In the heat exchangers K2 to K6, the penetrated bulge portions 24*a* to 24*c*, 36, 38 and 44*a* to 44*c* are provided between the longitudinally neighboring heat transfer tubes 13 and each of the legs 25*a* to 25*c*, 37*c*, 39*c* and 45*a* to 45*c* of the penetrated bulge portions 24*a* to 24*c*, 36, 38 and 44*a* to 44*c*, which is disposed adjacent to each of the longitudinally neighboring heat transfer tubes 13, is formed in such a direction and at such positions as to extend substantially along an outer periphery of each of the longitudinally neighboring heat transfer tubes 13. By this arrangement, dead water regions produced downstream of the heat transfer tubes 13 are reduced and effective area of heat transfer can be increased. Furthermore, since the distance from the heat transfer tubes 13 to the legs of the penetrated bulge portions is small, efficiency of the fins 11 is high. Since a sum of the lengths of the penetrated bulge portions 24*a* to 24*c*, 36, 38 and 44*a* to 44*c* is large, it is possible to secure wide regions in which the leading edge effect of thermal the boundary layer is conspicuous, thereby resulting in excellent heat transfer performance.

(17) In the heat exchangers K2 to K6, each of the legs 25*d*, 37*d*, 39*d* and 45*d* of the penetrated bulge portions 24*c*, 36, 38 and 44*c*, which is remote from the longitudinally neighboring heat transfer tubes 13, is so formed as to extend substantially in the direction of the arrow A. By this arrangement, the air flow is streamlined so that an increase of noise due to air flow can be lessened without much increase of air flow resistance.

What is claimed is:

1. A finned heat exchanger comprising:

a plurality of elongated fins arranged at a predetermined interval parallel with one another, such that air can flow in a predetermined direction between adjacent said fins;

a plurality of heat transfer tubes orthogonally extending through said fins and arranged in at least two columns including a relatively upstream column with regard to said predetermined direction and a relatively downstream column with regard to said predetermined direction, said columns being spaced from each other in said predetermined direction, and said tubes being interconnected such that refrigerant flows therethrough from an inlet to an outlet via two paths in the vicinity of said inlet and a single path in the vicinity of said outlet, said tubes of said single path comprising about 5 to 30% of all of said tubes;

said tubes of said single path being located in said relatively upstream column;

one of said tubes to have pass therethrough the refrigerant in a subcooled liquid state or a superheated gaseous state being located in a first said column;

each said fin having heat insulation in a central portion of a face of said each fin at a location between said one tube and an adjacent tube of an adjacent said column of tubes; and said heat insulation comprises a plurality of cut portions in alignment and separated by uncut portions; and said cut portions being substantially equal in length, and said uncut portions being substantially equal in length, each said fin having an overall length, said overall length divided by a sum of said equal length of said cut portions and said equal length of said uncut portions resulting in a remainder, and one of said cut portions being lengthened by a distance equal to said remainder, said one cut portion being adjacent to and downstream of said tubes of said single path.

2. A heat exchanger as claimed in claim 1, further comprising a plurality of penetrated bulge portions on one face of each said fin, said bulge portions being aligned in columns at positions between longitudinally adjacent said tubes, each said bulge portion having a width equal approximately to one-third to one-half of an interval between laterally adjacent said bulge portions.

3. A heat exchanger as claimed in claim 2, wherein each said bulge portion has a height approximately equal to one-half to one-third the height of fin collars of said each fin.

4. A heat exchanger as claimed in claim 2, wherein said bulge portions are arranged in laterally spaced columns from a centerline between longitudinally adjacent said tubes, a number of said bulge portions in a first said column closest to said centerline being a minimum number, and a number of said bulge portions in each remaining said column being equal to or greater than said minimum number as said each remaining column is spaced from said centerline.

5. A heat exchanger as claimed in claim 2, wherein each said bulge portion is positioned between longitudinally adjacent said tubes and has a leg adjacent to and extending along a periphery of one of said longitudinally adjacent tubes.

6. A finned heat exchanger comprising:

a plurality of elongated fins arranged at a predetermined interval parallel with one another, such that air can flow in a predetermined direction between adjacent said fins;

a plurality of heat transfer tubes orthogonally extending through said fins and arranged in at least two columns including a relatively upstream column with regard to said predetermined direction and a relatively downstream column with regard to said predetermined direction, said columns being spaced from each other in said predetermined direction, and said tubes being interconnected such that refrigerant flows therethrough from an inlet to an outlet via two paths in the vicinity of said inlet and a single path in the vicinity of said outlet, said tubes of said single path comprising about 5 to 30% of all of said tubes;

said inlet being formed by two said tubes of said two paths and located in said relatively downstream column;

said tubes of said single path being located in said relatively upstream column adjacent said two tubes of said two paths that form said inlet; and one of said tubes to have pass therethrough the refrigerant in a subcooled liquid state or a superheated gaseous state being located in a first said column, and each said fin has heat insulation in a central portion of a face of said each fin at a location between said one tube and an adjacent tube of an adjacent said column of tubes, said heat insulation comprising a plurality of cut portions in alignment and separated by uncut portions, most of said cut portions being substantially equal in length, and said uncut portions being substantially equal in length, each said fin having an overall length, said overall length divided by a sum of said equal length of most of said cut portions and said equal length of said uncut portions resulting in a remainder, and one of said cut portions being lengthened by a distance equal to said remainder.

7. A heat exchanger as claimed in claim 6, wherein said cut portions extend in a longitudinal direction of said each fin.

8. A heat exchanger as claimed in claim 7, wherein said equal length of most of said cut portions is not less than a diameter of each said tube and not greater than six times a longitudinal interval between adjacent said tubes.

9. A heat exchanger as claimed in claim 7, wherein each said fin comprises at least two separate fin portions, and an end of one of said cut portions is disposed adjacent a location of separation between said two fin portions on one of said fin portions having a final one of said tubes in said single path.

10. A heat exchanger as claimed in claim 6, wherein each said uncut portion has a length no greater than one-half a diameter of said tubes.

11. A heat exchanger as claimed in claim 6, wherein said cut portions and uncut portions extend between opposite ends of said each fin.

12. A heat exchanger as claimed in claim 6, further comprising a plurality of penetrated bulge portions on one face of each said fin, said bulge portions being aligned in columns at positions between longitudinally adjacent said tubes, each said portion having a width equal approximately to one-third to one-half of an interval between laterally adjacent said bulge portions.

13. A heat exchanger as claimed in claim 12, wherein at least one said bulge portion is positioned between longitudinally adjacent said tubes and has a leg remote from one of said longitudinally adjacent tubes and extending substantially in said predetermined direction.

14. A heat exchanger as claimed in claim 6, wherein said one cut portion is adjacent to and downstream of said tubes of said single path.

* * * * *